US006994423B2

(12) United States Patent
Jones

(10) Patent No.: US 6,994,423 B2
(45) Date of Patent: Feb. 7, 2006

(54) PRINTER CARRIAGE INTERLOCK FOR INK CASSETTE

(75) Inventor: Bruce S. Jones, Franklin, TN (US)

(73) Assignee: Nu-Kote International, Inc., Franklin, TN (US)

( * ) Notice: Subject to any disclaimer, the term of this patent is extended or adjusted under 35 U.S.C. 154(b) by 0 days.

(21) Appl. No.: 10/803,253

(22) Filed: Mar. 18, 2004

(65) Prior Publication Data

US 2005/0206699 A1 Sep. 22, 2005

(51) Int. Cl.
*B41J 2/14* (2006.01)

(52) U.S. Cl. ..... 347/49; 347/85; 347/86; 400/174; 400/175

(58) Field of Classification Search ..... 347/49, 347/85, 86; 400/174, 175
See application file for complete search history.

(56) References Cited

U.S. PATENT DOCUMENTS

| | | | | |
|---|---|---|---|---|
| 5,646,665 | A * | 7/1997 | Swanson et al. | 347/87 |
| 6,749,294 | B2 * | 6/2004 | Haldorsen | 347/87 |
| 6,779,874 | B2 * | 8/2004 | Sturgeon et al. | 347/49 |
| 6,796,646 | B2 * | 9/2004 | Komplin et al. | 347/86 |

* cited by examiner

*Primary Examiner*—Andrew H. Hirshfeld
*Assistant Examiner*—Dave A. Ghatt
(74) *Attorney, Agent, or Firm*—Fay, Sharpe, Fagan, Minnich & McKee, LLP

(57) ABSTRACT

An interlock arrangement for selectively removably mounting an ink cassette in the chute of a printer carriage comprises an ink cassette including a notch or recess and an interlock clip selectively connectable to a side of a printer carriage chute and cooperates with the notch member to provide an interlock which allows insertion of the ink cassette into the chute and prevents insertion of an ink cassette that does not have a notch or recess.

24 Claims, 2 Drawing Sheets

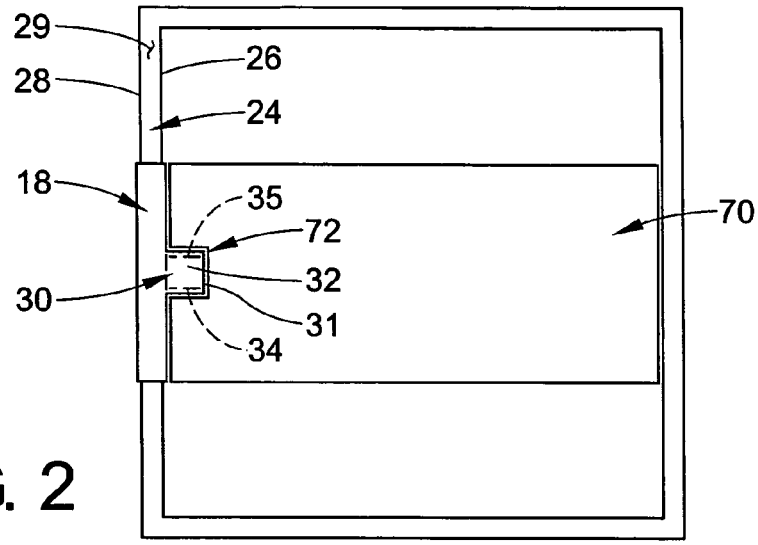
FIG. 2
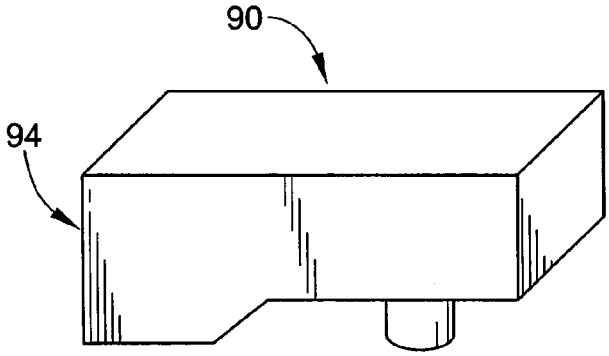
FIG. 3
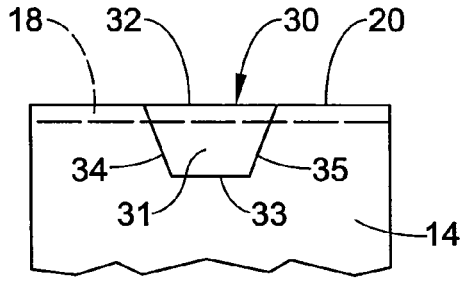
FIG. 5
FIG. 4
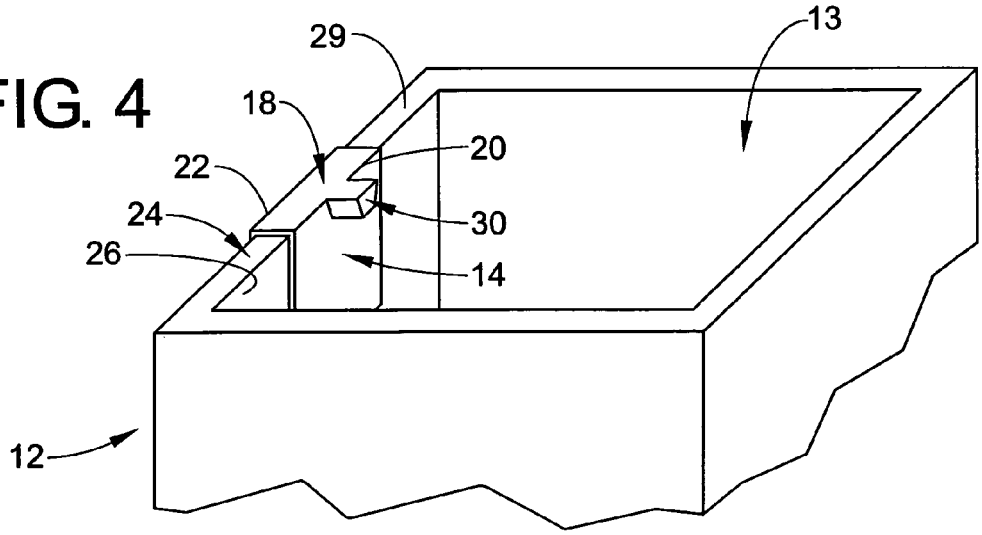

PRINTER CARRIAGE INTERLOCK FOR INK CASSETTE

The present invention relates to a printer carriage interlock for ink cassettes or cartridges, and more specifically, to an interlock clip adapted for selective mounting with a compartment or chute of a printer carriage whereby the interlock clip allows insertion of one or more cassettes of a first family of ink cassettes and prevents insertion of a cassette from a second family of ink cassettes into the compartment.

BACKGROUND OF THE INVENTION

Printers, typically networked or connected to computers, are used for printing a variety of images utilizing a multitude of interchangeable ink cassettes on a variety of print media. It has become common practice to interchange and/or switch ink cassettes or cartridges when changing print media, altering the desired ink (i.e. color, edible, non-edible, etc.), or when replacing a depleted ink cassette. Typically, an ink cartridge or ink cassette includes an identifying arrangement which allows only standard or specific ink cartridges to be loaded into a particular type or brand of printer. Some ink cassettes, in order to be loaded into a particular printer, are provided with projection and recess pattern portions formed on an outer surface thereof. An electrode portion can be arranged on the projection and recess pattern portions. The projection and recess patterns can be in the form of a mechanical key scheme integrated into a composite pattern on both a print cartridge and its corresponding printer carriage chute or compartment. The pattern can incorporate a plurality of adjacent contiguous columns on both sides of a latch, with each column capable of defining multiple position bits in order to precisely differentiate between different types and/or different families of print cartridges. Thus, printer carriage chutes can differentiate and prevent certain types and/or certain families of print cartridges from entering the chute. Such mechanical keys are usually developed by original equipment manufacturers (OEM) whereby only certain print cassettes will work with a corresponding brand of printer. The current mechanical key schemes provide a predetermined and fixed differentiation between different types and/or different families of print cartridges.

Devices heretofore available do not enable selectively altering the mechanical key schemes or interlock. In today's environment printers are required to do more and must be able to allow for a variety of different ink cassettes to accomplish different objectives. For example, different ink cassettes can be used, especially for home use or small business, where different colors and/or different types of ink may be desired. One application is for the printing of edible ink onto, for example, rice paper. This particular application is the result of business in the cake or food decorating environment. Several suppliers currently make ink cassettes for OEM printers which use food dyes or edible ink. The edible ink goes into and through the printing nozzles and out onto the rice paper which can subsequently be laid on icing for bakery cakes to create custom images or pictures. Once rice paper has been loaded into the paper tray and/or when edible ink is required, it is desirable to only allow edible ink cassettes to be inserted into the printer carriage. This necessitates that the printer carriage now prohibit insertion of an originally insertable ink cassette into the printer carriage. It is to be appreciated that the originally or previously insertable ink cassette includes non-edible ink which now must be prohibited from printing on rice paper, or other similar material, which may later be consumed by a person. At present, the printer industry is using commercially available ink jet printers and filling special cassettes with edible ink. The end user may mistake the normal ink jet cassette (filled with industrial dyes) and put it into the printer, thus creating a health hazard and liability risk.

The ability to selectively interchange ink cassettes for different purposes increases the versatility of a printer, especially for home use or small business use where it is cost prohibitive to acquire separate printers for specialized purposes. Thus, it is desirable to safely interchange ink cassettes for different purposes thereby increasing the versatility of a printer while reducing and/or eliminating any health hazards or other problems or potential problems.

SUMMARY OF THE INVENTION

The present invention provides an interlock arrangement for, for example, ink jet printers and ink cassettes of the type described which overcome the above-referred to difficulties and others, and is easy to manipulate, insert, and remove. More particularly in this respect, an interlock arrangement is provided for removable ink cassettes selectively mounted in printer carriages comprising a first family of ink cassettes wherein each cassette includes a first interlocking member thereon. An interlock clip is selectively connected to a side of a carriage chute and includes a second interlocking member which cooperates with the first interlocking member to provide an interlock arrangement allowing exclusive insertion of cassettes of the first family of ink cassettes.

In accordance with another aspect of the invention, first and second interlock clips respectively cooperable with the cassettes of first and second families of cassettes are selectively mounted in a printer carriage chute whereby the latter exclusively receives the cassettes of the family of ink cassettes corresponding to the selected clip.

In yet another aspect of the invention, a method of selectively allowing insertion of cassettes of a first family of ink cassettes and preventing insertion of cassettes of a second family of ink cassettes into a printer carriage chute is provided comprising the steps of: providing an interlock clip including an interlocking member cooperable with an interlocking member on a cassette of the first family, but not cooperable with an interlocking member on a cassette of the second family; and connecting the interlock clip to a wall of the printer carriage chute thereby creating a barrier within the carriage chute to prevent insertion of cassettes of the second family of ink cassettes.

BRIEF DESCRIPTION OF THE DRAWINGS

The invention may take physical form, in certain parts and arrangements of parts, embodiments of which will be described in detail in the specification, and are illustrated in the accompanying drawings, which form a part hereof and wherein:

FIG. 2 is a top view of the interlock clip and ink cassette installed in the printer carriage according to the present invention;

FIG. 3 is a perspective view of an unmodified ink cassette;

FIG. 4 is a perspective view of the interlock clip connected to the printer carriage according to the present invention; and, FIG. 5 is an enlarged elevation view of the interlocking member on the clip, looking from right to left in FIG. 4.

DESCRIPTION OF A PREFERRED EMBODIMENT OF THE INVENTION

Figure 1:
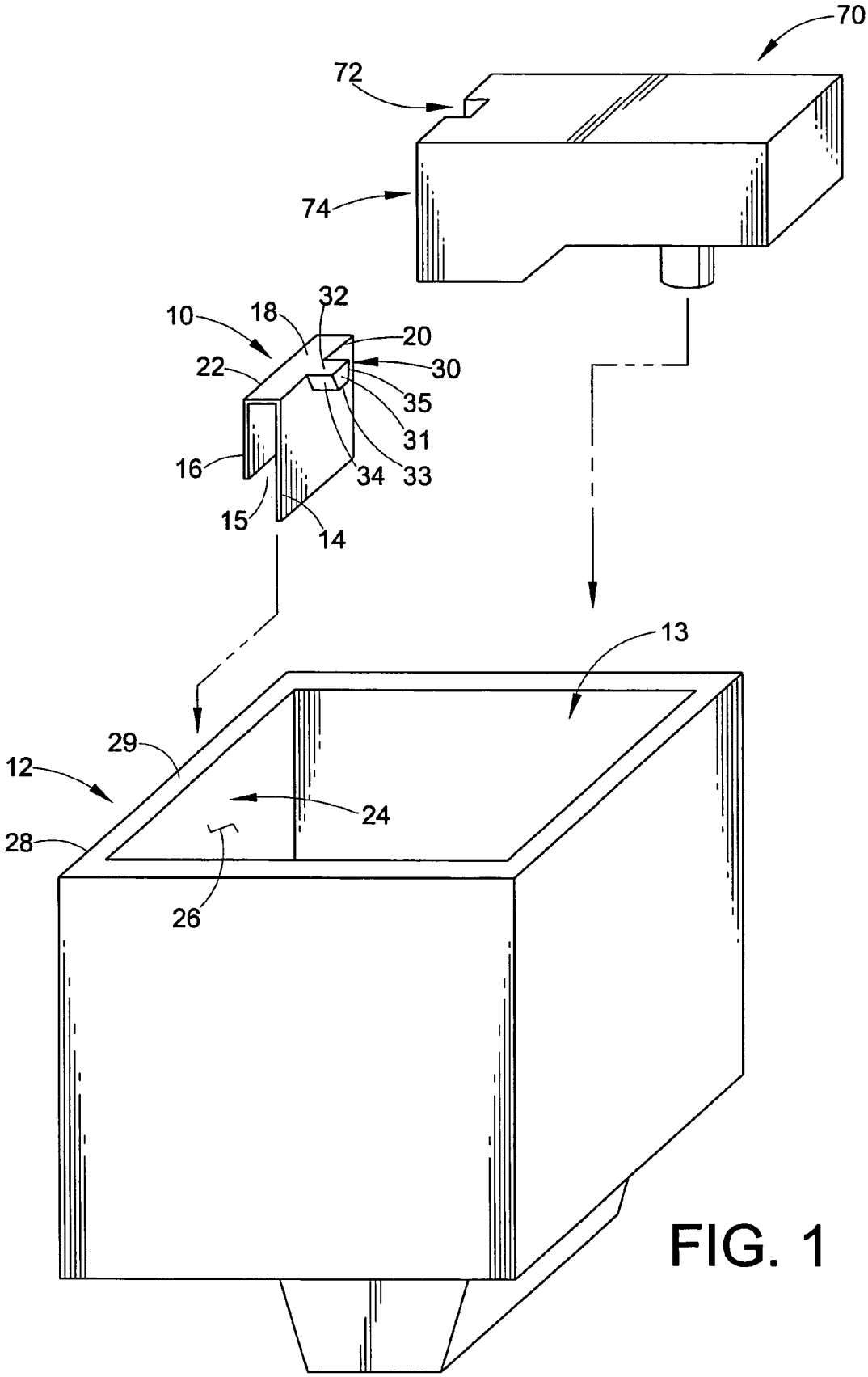
FIG. 1 is an exploded perspective view of an ink cassette and interlock clip in a premounting orientation relative to a printer carriage according to the present invention.

Referring now in greater detail to the drawings, wherein the showings are for the purpose of illustrating a preferred embodiment of the invention only, and not for the purpose of limiting the invention, FIG. 1 shows an interlock clip 10 in a premount position which can be generally above or adjacent one side of a printer carriage 12. The printer carriage 12 can be an OEM carriage or similar and includes an open compartment or chute 13 therein. The interlock clip 10 includes an inside leg or wall 14 and an outside leg or wall 16. The inside leg 14 and outside leg 16 are attached by a connecting member 18, and the legs 14 and 16 extend generally parallel to each other. The connecting member 18 preferably extends perpendicular to the legs 14 and 16 and is attached thereto at upper edges 20 and 22, respectively. The inside and outside legs form a channel 15 therebetween which receives side wall 24 of the carriage 12 when the clip is mounted thereon. The legs can be in frictional engagement with opposing inside and outside faces 26 and 28 of wall 24 and, when mounted on the wall, connecting member 18 contacts top or edge 29 of the side wall 24. It will be appreciated that the clip can be removably mounted on wall 24 in any desired manner and, for example, can simply rest on top edge 29.

In the embodiment shown, inside leg 14 has an interlocking member 30 in the form of a projection, tab or finger extending generally orthogonal thereto toward the inside area of chute 13 of printer carriage 12. It is to be appreciated that the tab 30 can have any one of a number of different configurations. Referring to FIGS. 1, 4 and 5, the tab 30 has a front or inner wall 31, a top wall 32, a bottom wall 33, and laterally spaced apart side walls 34 and 35. In this configuration, the interlocking member has a trapezoidal profile defined by parallel top and bottom walls 31 and 32 and side walls 34 and 35 which taper downwardly and inwardly from the top wall 32 to bottom wall 33.

FIGS. 1 and 3 respectively show first and second cassettes 70 and 90 which are structurally and dimensionally identical with the exception that cassette 70 has a vertically extending notch, slot or recess 72 in an end wall 74 thereof while the corresponding end wall 94 of cassette 90 is planar. Accordingly, it will be appreciated that a plurality of cassettes 70 define a first family of cassettes while a plurality of cassettes 90 define a second family. The printer carriage chute 13, as manufactured, is capable of receiving cassettes of either of the first and second families of ink cassettes. The chute 13 can be of any number of configurations but generally is rectangular, square, or of similar configuration.

The slot 72 in wall 74 extends from the bottom to the top of the ink cassette 70 and is adapted to receive tab 30 on the interlock clip 10. It will be appreciated that the downwardly and inwardly slanting side walls 34 and 35 provide a tapered profile to facilitate sliding interengagement between the slot and tab with minimal interference. The ink cassettes 90 of the second family are not provided with a notch extending along wall 94. Thus, when the interlock clip 10 is connected to the printer carriage 12 only cassettes 70 can be mounted or received in the chute 13 of the printer carriage 12. The cassettes 90 will be prevented from insertion into the chute 13 by the tab 30 abutting against the bottom of the ink cassettes.

As an example, with respect to selectively allowing one variety of ink cassettes and prohibiting another variety of ink cassettes from being introduced into the carriage chute, and assuming the intent to print edible ink on rice paper, once the printer has been selected for printing decorative prints on rice paper for use on cakes or other edibles, the interlock clip 10 can be installed in the chute 13 of the carriage 12 whereby only cassettes 70, containing edible ink, can be used. Similarly, for example, if the printer is then to be used for printing with non-edible ink, the interlock clip 10 can be removed thereby allowing insertion of cassettes 90.

While considerable emphasis has been placed herein on the structures and configuration of a preferred embodiment of the invention, it will be appreciated that other embodiments, as well as modifications of the embodiment disclosed herein, can be made without departing from the principals of the invention. In this respect, it will be appreciated that the interlock clip according to the invention, and especially tab 30 thereof, can be of any number of different dimensions and/or configurations. For example, the clip can include multiple projections for selectively allowing multiple cassettes into the carriage. Also, the relationship between the clip and cassette can be reversed, i.e. the tab on the cassette and the slot extending along the clip. These and other modifications of the embodiment shown will be obvious and suggested to those skilled in the art from the disclosure herein. It is be distinctly understood, therefore, that the foregoing descriptive matter is to be interpreted merely as illustrative of the present invention and not as a limitation thereof. It is intended that the invention be construed as including all such modifications and alterations as fall within the scope of the appended claims or the equivalents thereof.

What is claimed is:

1. An ink cassette and interlock member for mounting on a printer carriage, comprising:

an ink cassette;

an interlock member for selective attachment to the carriage of a printer; and, a slot formed on an upper end of said cassette and a tab formed on said interlock member for releasably interengaging said cassette and said interlock member.

2. The ink cassette and interlock member of claim 1, wherein said tab includes a trapezoidal profile.

3. The ink cassette and interlock member of claim 1, wherein said tab is releasably interengaged with a first family of ink cassettes, said first family of ink cassettes include edible ink.

4. The ink cassette and interlock member of claim 1, wherein said tab of said interlock member prevents insertion of a second family of ink cassettes.

5. The ink cassette and interlock member of claim 4, wherein said tab is releasably interengaged with a first family of ink cassettes, said first family of ink cassettes include edible ink.

6. The ink cassette and interlock member of claim 5, wherein said second family of ink cassettes include non-edible ink.

7. The ink cassette and interlock member of claim 1, wherein said interlock member comprises a clip which is releasably secured to an upper wall of said printer carriage.

8. The ink cassette and interlock member of claim 7, wherein said tab of said interlock member extends from said clip.

9. The ink cassette and interlock member of claim 7, wherein said clip comprises a first leg and a second leg, wherein one of said legs is longer than the other of said legs.

10. The ink cassette and interlock member of claim 1, wherein said slot comprises tapered walls and said tab comprises tapered surfaces which frictionally engage said tapered walls of said slot to guide said cassette into said carriage.

11. The ink cassette and interlock member of claim 1, wherein said cassette is inserted directly into said cartridge as said slot engages said tab without rotation of said cassette.

12. The ink cassette and interlock member of claim 1, wherein said interlock member comprises a first leg member and a second leg member extending from said first leg member, wherein said first leg member and said second leg member are of uniform thickness.

13. The ink cassette and interlock member of claim 12, wherein said tab extends from said first leg for selectively engaging said slot in a cassette, wherein said cassette has edible ink therein.

14. The ink cassette and interlock member of claim 13, wherein said tab prevents a cassette with non-edible ink from being received within said carriage.

15. An ink cassette and interlock member for mounting on a printer carriage, comprising:

an ink cassette;

an interlock member for selective attachment to the carriage of a printer comprising an inside leg and an outside leg including a connecting member therebetween;

said inside leg comprising a tab extending from said inside leg into a chute of said carriage;

said tab connected to said interlock member being cooperative with a slot in said ink cassette for releasably interengaging said cassette and said interlock member as said cassette slides vertically into said carriage without pivoting said cassette.

16. The ink cassette and interlock member of claim 15, wherein said carriage chute has an upper peripheral edge;

said inside leg and said outside leg slidingly engage opposing surfaces of a side of said chute; and, said connecting member sits upon a portion of said peripheral edge when said interlock member is connected to said chute.

17. The ink cassette and interlock member of claim 15, wherein said tab includes a trapezoidal profile.

18. The ink cassette and interlock member of claim 15, wherein said tab is releasably interengaged with a first family of ink cassettes, said first family of ink cassettes include edible ink.

19. The ink cassette and interlock member of claim 15, wherein said tab of said interlock member prevents insertion of a second family of ink cassettes.

20. The ink cassette and interlock member of claim 19, wherein said tab is releasably interengaged with a first family of ink cassettes, said first family of ink cassettes include edible ink.

21. The ink cassette and interlock member of claim 20, wherein said second family of ink cassettes include non-edible ink.

22. A method of mounting an ink cassette in a printer carriage chute comprising the steps of:

providing an interlock member having one of a mating projection and recess thereon;

providing an ink cassette with the other of the projection and recess;

connecting said interlock member to a printer carriage chute;

vertically sliding said cassette into said carriage chute; and, interengaging the mating projection and recess as said cartridge slides into said carriage chute without pivoting said cassette.

23. The method of claim 22, further including the steps of:

providing a first family of ink cassettes, said first family of ink cassettes include said other of the mating projection and recess; and, providing said first family of ink cassettes with edible ink.

24. The method of claim 23, further including the steps of:

removing said first family of ink cassettes from said carriage chute; and, disconnecting said interlock member from said printer carnage chute thereby removing said one of a mating projection and recess within said carriage chute to allow insertion of a second family of ink cassettes.

* * * * *